US007409175B2

(12) United States Patent
Kim et al.

(10) Patent No.: US 7,409,175 B2
(45) Date of Patent: Aug. 5, 2008

(54) IMAGE FORMING APPARATUS AND IMAGE READING APPARATUS WITH LOCKING UNIT FOR LOCKING MOVABLE OBJECT

(75) Inventors: Young-min Kim, Suwon-si (KR); Sang-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/340,792

(22) Filed: Jan. 27, 2006

(65) Prior Publication Data

US 2006/0177237 A1 Aug. 10, 2006

(30) Foreign Application Priority Data

Feb. 7, 2005 (KR) ..... 10-2005-0011147

(51) Int. Cl.
*G03G 15/00* (2006.01)

(52) U.S. Cl. ..... 399/107; 399/110; 399/391; 399/393

(58) Field of Classification Search ..... 399/107, 399/110–125, 391–393
See application file for complete search history.

(56) References Cited

U.S. PATENT DOCUMENTS 5,157,448 A * 10/1992 Lang ..... 399/23
5,191,376 A * 3/1993 Hayashi ..... 399/201
6,510,301 B2 * 1/2003 Tanaka ..... 399/125
6,768,887 B2 * 7/2004 Mikita et al. ..... 399/122
2003/0076545 A1 * 4/2003 Liu ..... 358/474

FOREIGN PATENT DOCUMENTS

| | | |
|---|---|---|
| JP | 59-88727 | 5/1984 |
| JP | 60-211470 | 10/1985 |
| JP | 64-29829 | 1/1989 |
| JP | 5-294521 | 11/1993 |
| JP | 10-293431 | 11/1998 |
| KR | 1988-4356 | 6/1988 |
| KR | 2001-4136 A | 1/2001 |
| KR | 2001-32466 | 4/2001 |
| KR | 2003-63100 A | 7/2003 |
| KR | 2003-95139 A | 12/2003 |

* cited by examiner

*Primary Examiner*—David M. Gray
*Assistant Examiner*—Ruth N Labombard
(74) *Attorney, Agent, or Firm*—Stein, McEwen & Bui, LLP

(57) ABSTRACT

An image forming apparatus includes an image forming body, a locking unit blocking movement of at least one movable object of the image forming body, and a control unit controlling a locking state of the locking unit and a releasing state of the locking unit. The locking unit includes a latching member provided on one of the at least one movable object and provided with a latching depression, a supporting member provided on the image forming body, and a locking member movably supported by the supporting member so as to be insertable into and removable from the latching depression of the latching member.

25 Claims, 6 Drawing Sheets

IMAGE FORMING APPARATUS AND IMAGE READING APPARATUS WITH LOCKING UNIT FOR LOCKING MOVABLE OBJECT

CROSS-REFERENCE TO RELATED APPLICATIONS

This application claims the benefit of Korean Patent Application No. 2005-11147 filed on Feb. 7, 2005, in the Korean Intellectual Property Office, the disclosure of which is incorporated herein by reference.

BACKGROUND OF THE INVENTION

1. Field of the Invention

An aspect of the present invention relates to an image forming apparatus and an image reading apparatus. More specifically, an aspect of the present invention relates to an image forming apparatus and an image reading apparatus in which movable objects (for example, an image reading unit, an opening/closing member, a recording material cassette, and the like) are locked so as not to move when a product is shipped, and a locking structure is automatically released when the product is unpacked and used for the first time by a user.

2. Description of the Related Art

Conventionally, apparatuses such as a digital photocopier, a facsimile machine, a printer, and a multifunction device having an image reading section, an image forming section, and an automatic document conveyer are known.

The image reading section is a device for reading image information of supplied documents, and the image forming section is a device for printing images on recording materials based on the image information read by the image reading section. The automatic document conveyer is a device for supplying documents one sheet at a time to a reading position of the image reading section, and ejecting documents to a document ejection tray after the documents have been read.

FIG. 1 shows a configuration of a conventional image forming apparatus disclosed in Japanese Unexamined Patent Application Publication No. 10-293431 published on Nov. 4, 1998, and FIG. 2 is a perspective view showing a configuration of an image reading section of the image forming apparatus in FIG. 1.

Referring to FIG. 1, an image forming apparatus includes an image reading section 1*s* for reading images of documents S and B, and an image forming section 1*p* for forming images on recording materials based on the image information read by the image reading section 1*s*.

A pressing panel 1 is installed on a frame 2 with hinges 1*h* to rotate through a certain angular range about a hinge axis 1*g*.

Referring to FIG. 2, a document stacking tray 1*c* is provided on the top of the pressing panel 1 in order to stack documents S. A document ejecting conveyer 5 is provided at the upper portion of the pressing panel 1. The document ejecting conveyer 5 includes a preliminary conveyance roller 1*d* and a preliminary conveyance pressing panel 5*a* for conveying the documents S from the document stacking tray 1*c*, and a separating pad 5*b* and a separating roller 1*e* for separating the documents S that are conveyed by the preliminary conveyance roller 1*d* and the preliminary conveyance pressing panel 5*a* into individual sheets. In addition, the document ejecting conveyer 5 includes a document feed roller if and a paper feed roller 5*c* for feeding the documents S to a reading unit 6, with the paper feed roller 5*c* being pressed against the document feed roller if by a pressing panel spring (not shown).

A contact image sensor 4 is installed at a curved portion of a conveyance path, and a document pressing roller 5*d* for pressing and conveying the documents on the conveyance path is installed opposite the contact image sensor 4. The document pressing roller 5*d* is elastically pressed by a press spring 5*i* in the direction of the conveyance path, and if a document S enters the reading unit 6, the document S is pressed by the document pressing roller 5*d* and conveyed while being in contact with a document base glass 2*a*.

The image reading section 1*s* described above can operate in either a flat-bed mode in which a stationary document is read, or a sheet-through mode in which a moving document is read.

In the flat-bed reading mode, a document B is placed on the document base glass 2*a*, and when the pressing plate 1 is rotated about the hinge axis 1*g*, the document B is pressed against the document base glass 2*a*. Then, the contact image sensor 4 moves in the direction of the arrow A, and reads an image of the document B placed on the document base glass 2*a*.

In the sheet-through reading mode, the contact image sensor 4 stands still at the position of the reading unit 6 and reads an image of a moving document S. The documents S placed on the document stacking tray 1*c* are first conveyed by the preliminary conveyance roller 1*d* and the preliminary conveyance pressing panel 5*a*, and are then separated into individual sheets by the separating roller 1*e* that is in contact with the separating pad 5*b*. Thereafter, the documents S are conveyed to the reading unit 6 by the paper feed roller 5*c* against which the document feed roller If is pressed by the pressing panel spring.

At the reading unit 6, the documents S are conveyed while being in contact with a surface of the document pressing roller 5*d*, and images of the documents S are read by the contact image sensor 4. The document pressing roller 5*d* is elastically pressed in the direction of the conveyance path by the press spring 5*i*, and prevents the documents S from floating on the document base glass 2*a*.

FIG. 3 shows an example of an image forming apparatus with a locking device 20 that holds an image reading sensor, such as the contact image sensor 4 described above, so that it does not move.

The image forming apparatus in FIGS. 1-2 described above uses a locking device 20 as shown in FIG. 3 to hold the contact image sensor 4 so that it does not move when the image forming apparatus is shipped.

Accordingly, a user can use the image reading section 1*s* only after the locking device 20 is released. If the locking device 20 is not released due to a user's mistake, the image reading section 1*s* cannot be used properly, and if serious problems occur as a result, service must be called for.

Conventionally, only a locking device 20 for locking an image reading sensor is provided. However, an image forming apparatus includes several easily movable parts, such as the pressing panel 1 and an opening/closing member for opening/closing the image forming section 1*p* described above, a recording material cassette for supplying recording materials on which images are printed based on the image information read by the contact image sensor 4, and the like. Therefore, in order to prevent the easily movable parts described above from moving when the image forming apparatus is shipped, packing materials must be carefully selected, and special fixing materials must be additionally attached to fix the easily movable parts in place to prevent them from moving.

SUMMARY OF THE INVENTION

The present invention addresses the above drawbacks and/or other problems in the related art. An aspect of the invention is to provide an image forming apparatus in which a locking unit which locks an image reading unit is automatically released when the image forming apparatus is used.

Another aspect of the invention is to provide an image forming apparatus in which locking units for locking movable objects other than the image reading unit are provided and are automatically released when the image forming apparatus is used.

Another aspect of the invention is to provide an image forming apparatus in which the amount of packing materials required to ship the image forming apparatus is reduced by using locking units for locking movable structures including an image reading unit.

According to one aspect of the invention, an image forming apparatus includes an image forming body, a locking unit blocking movement of at least one movable object of the image forming body, and a control unit controlling a locking state of the locking unit and a releasing state of the locking unit.

The at least one movable object may be any one or any combination of an image reading unit reading images of documents, a cover installed on the image forming body so as to be openable away from and closable against a top surface of a document base glass on which a document is to be placed, a recording material cassette supplying recording materials on which images are to be formed based on the images read by the image reading unit, the recording material cassette being attachable to and removable from the image forming body, a knock-up plate installed inside the recording material cassette on which recording materials are to be stacked, a covering member opening and closing the image forming body, a multipurpose paper feed device feeding recording materials one sheet at a time or performing other functions, and a recording material guide lining up recording materials stacked on the knock-up plate in a width direction and/or a length direction.

The covering member may be a rear cover installed on a rear surface of the image forming body to replace a fixing unit installed inside the image forming body and/or to remove jammed recording materials from inside the image forming body, and/or a top cover installed on a top surface of the image forming body to replace a developing unit installed inside the image forming body and/or to remove jammed recording materials from inside the image forming body.

The locking unit may include a latching member provided on one of the at least one movable object and provided with a latching depression, a supporting member provided on the image forming body, and a locking member movably supported by the supporting member so as to be insertable into and removable from the latching depression of the latching member.

The latching depression may have nut threads formed therein, and an end portion of the locking member may have bolt threads corresponding to the nut threads formed thereon. The nut threads may be formed in the latching depression only up to a point that is a certain distance away from an end of the latching depression.

The supporting member may be provided on the image forming body facing the latching member across a certain gap and may include a supporting frame provided with a supporting hole through which the locking member passes so as to be supported by the supporting frame of the supporting member, and an elastic member may be provided between a portion of the latching member and the supporting frame.

A manual operating unit may be provided at an end portion of the locking member to enable the locking member to be operated manually, and the manual operating unit may be a tool socket corresponding to a manual tool.

The control unit may include a controller judging if a state of the image forming apparatus is a state in which the locking unit is to be locked or a state in which the locking unit is to be released, a driving unit driving the locking unit, and a driver operating the driving unit according to an output signal of the controller if the controller judges the state of the image forming apparatus to be a state in which the locking unit is to be locked or a state in which the locking unit is to be released.

The driving unit may include a motor generating a driving force, a driving gear directly or indirectly connected to the motor and rotatable in a locking direction to lock the locking unit and a releasing direction to release the locking unit, and a gear provided on the locking member and engaging the driving gear.

The motor may be any one of motors that drive operating units in the image forming body, and the driving gear may be directly connected to the any one of the motors that drive the operating units or may be connected to the any one of the motors that drive the operating units through at least one relay gear.

The driving gear may rotate at a fixed position in a linear direction, and a thickness of the driving gear may be greater than a thickness of the gear provided on the locking member.

The state of the image forming apparatus in which the locking unit is to be released may be a state in which power to the image forming apparatus is turned on or a state in which operating units in the image forming body are ready to start operating, and the state of the image forming apparatus in which the locking unit is to be locked may be a state in which a locking command is set by a user.

According to another aspect of the invention, an image reading apparatus includes an image reading main body, a document base glass installed on a top surface of the image reading main body and having a top surface on which documents are to be placed in a stationary state and/or a moving state, an image reading unit installed facing the document base glass reading images of the documents placed on the document glass, a cover installed on the image reading main body so as to be openable away from and closable against the top surface of the document base glass, a locking unit blocking movement of the image reading unit or the cover, and a control unit controlling a locking state of the locking unit and a releasing state of the locking unit.

According to another aspect of the invention, an image forming apparatus includes an image forming body, a movable object disposed in the image forming body, a controllable locking unit to selectively lock the movable object to prevent the movable object from moving and release the movable object to allow the movable object to move, and a control unit to control the controllable locking unit to selectively lock and release the movable object.

According to another aspect of the invention, an image reading apparatus includes an image reading main body, a document base glass disposed on the main body on which a document is to be placed, an image reading unit disposed in the image reading main body facing the document base glass and being movable relative to the document base glass to read an image of a document placed on the document base glass, a cover disposed on the image forming body and being openable away from and closable against the document base glass, a controllable locking unit to selectively lock the image reading unit or the cover to prevent the image reading unit or the cover from moving and release the image reading unit or the cover to allow the image reading unit or the cover to move, and a control unit to control the controllable locking unit to selectively lock and release the image reading unit or the cover.

In an image forming apparatus according to an aspect of the invention described above, the locking units used to prevent movable objects from moving during shipping of the image forming apparatus need not be manually released by a user, thereby making the image forming apparatus convenient for the user to use.

In addition, the amount of packing materials required to prevent movement of movable objects in the image forming apparatus is reduced, thereby decreasing the consumption of packing materials which will be thrown away and reducing the space required to pack the image forming apparatus for shipping.

In addition, a user cannot use the image forming apparatus without releasing the locking units, thereby eliminating service calls resulting from the user trying to use the image forming apparatus without first releasing the locking units.

In addition, relocking of the locking units can be performed as needed, thereby allowing reuse of the locking units when moving the image forming apparatus to a different place where it is to be used.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
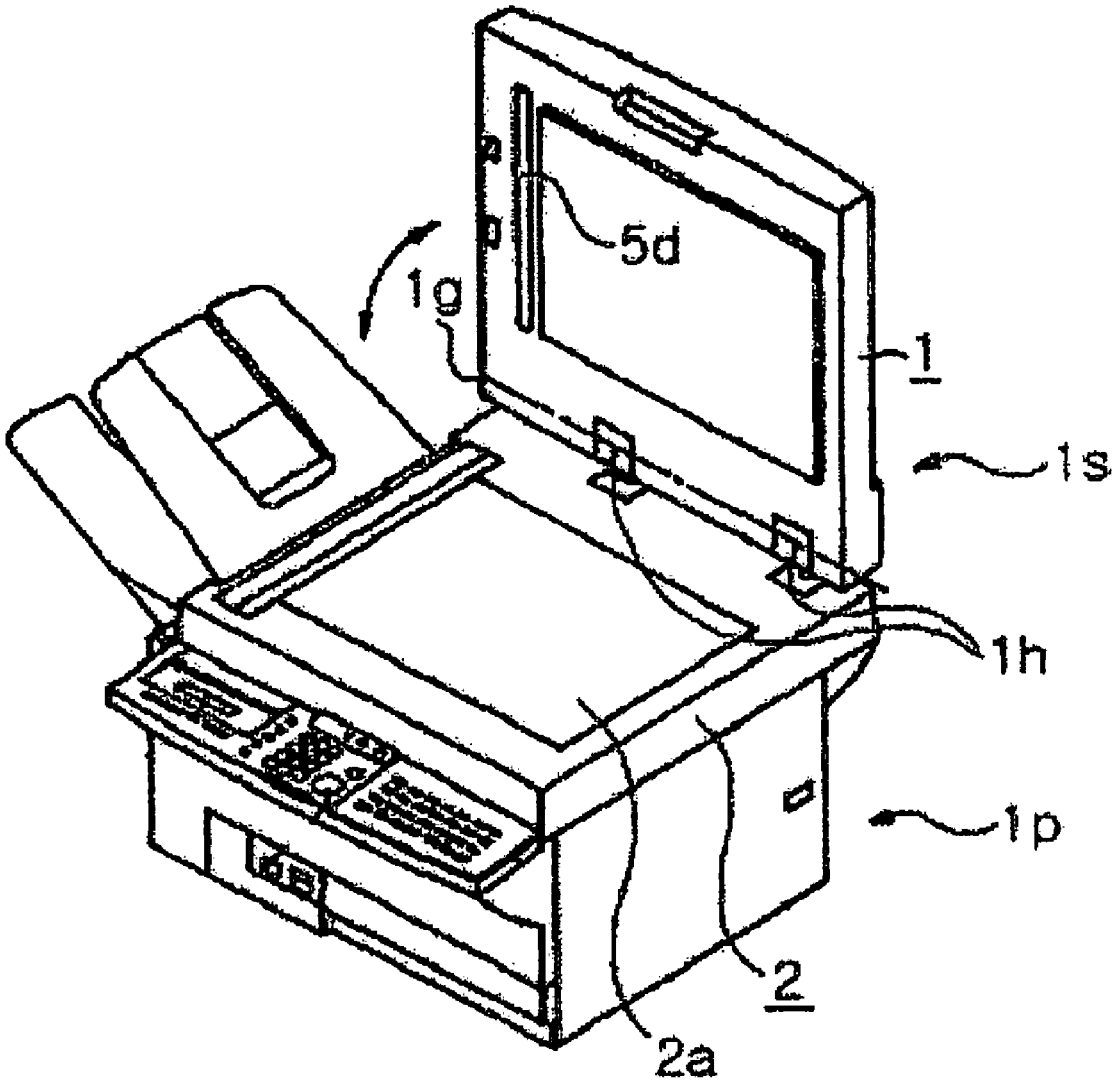
FIG. 1 (PRIOR ART)
FIG. 1 shows a configuration of a conventional image forming apparatus.
Figure 2:
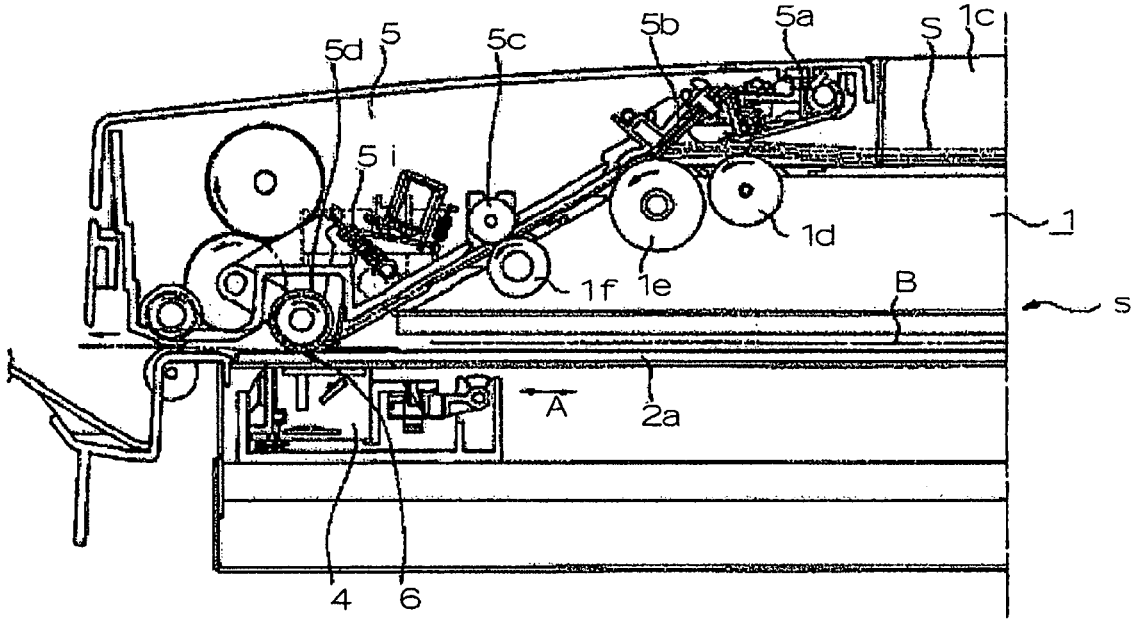
FIG. 2 (PRIOR ART)
FIG. 2 shows a configuration of an image reading section shown in FIG. 1.
Figure 3:
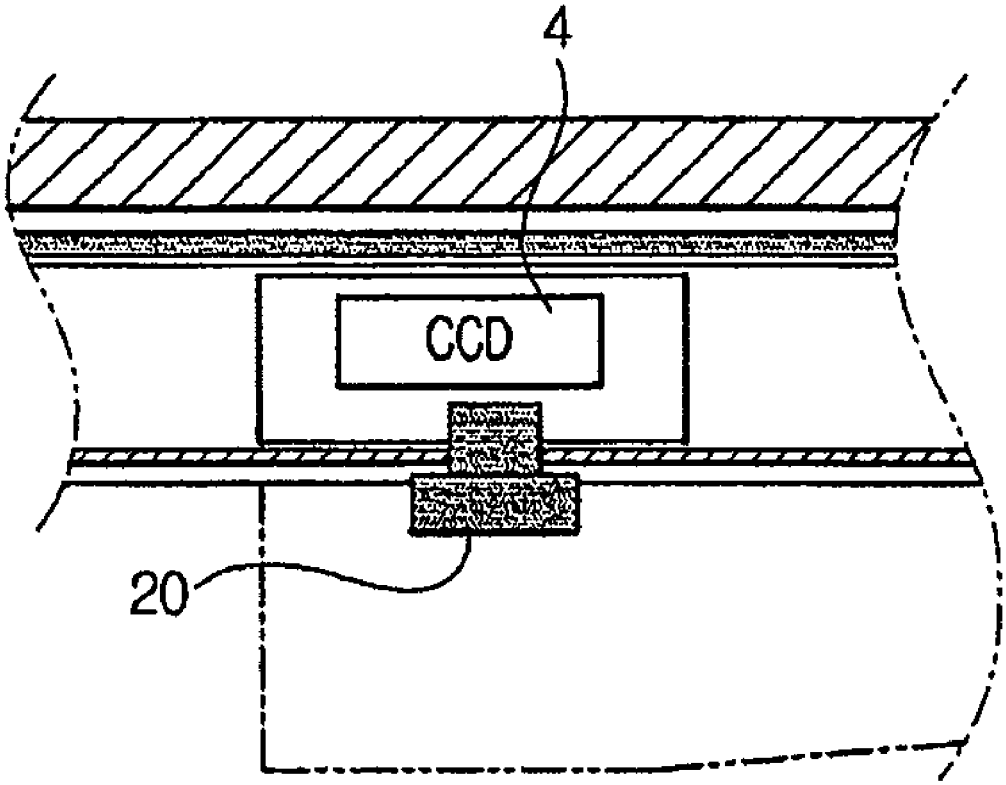
FIG. 3 (PRIOR ART)
FIG. 3 shows an example of an image forming apparatus with a locking device that holds an image reading sensor so that it does not move.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
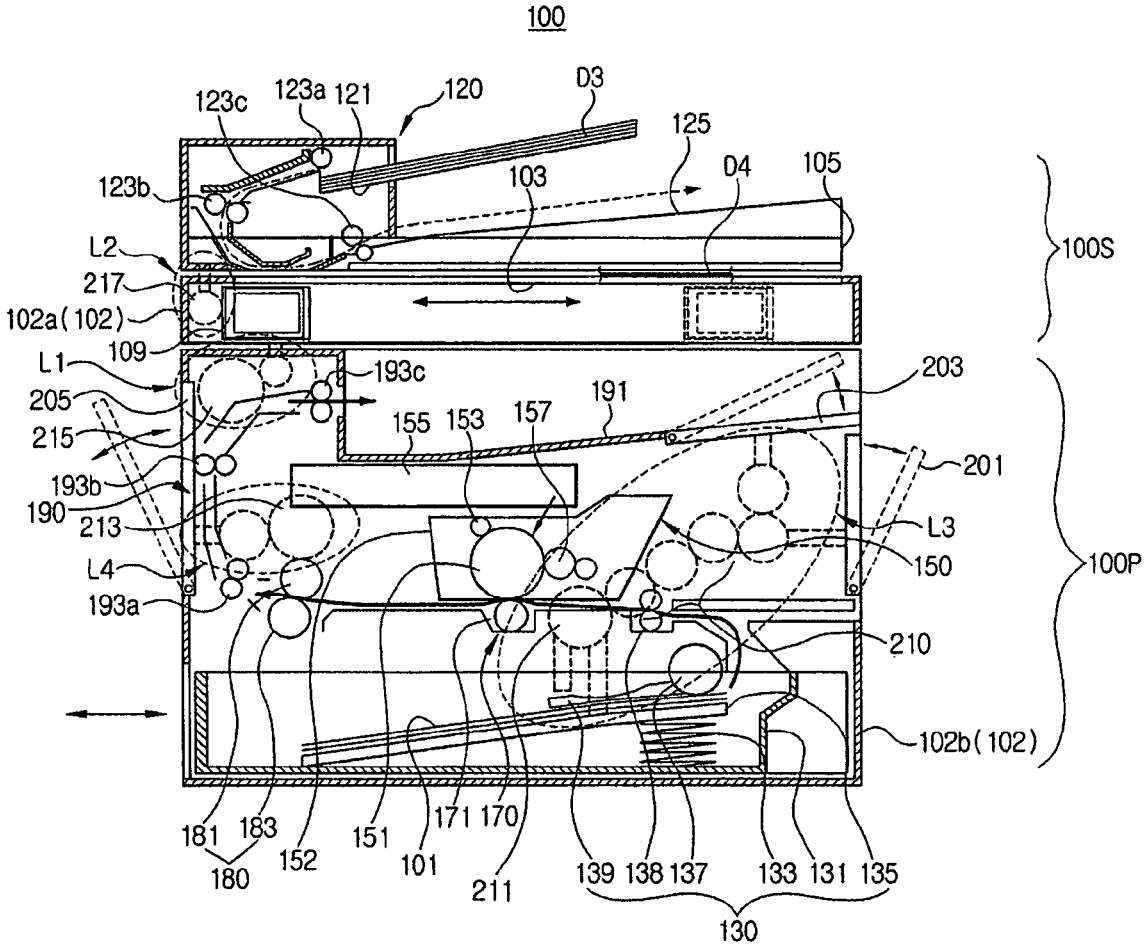
FIG. 4 shows a configuration of an image forming apparatus according to one embodiment of the invention.

FIG. 4 shows a configuration of an image forming apparatus according to one embodiment of the invention.

Referring to FIG. 4, an image forming apparatus 100 includes an image reading section 100S, and an image forming section 100P for forming images on recording materials 101 using an electrophotographic method based on image information read by the image reading section 100S.

The image reading section 100S includes an image reading frame 102*a*, a document base glass 103, a cover 105, an automatic document feeding unit 120, and an image reading unit 109.

More specifically, the image reading section 100S includes the image reading frame 102*a* as a portion of an image forming body 102. The document base glass 103 is installed on top of the image reading frame 102*a*, and the image reading unit 109 is installed so as to read an image of a document D3 supplied through the automatic document feeding unit 120 after being moved to a predetermined position inside the image reading frame 102*a*, or to read an image of a document D4 resting on the upper surface of the document base glass 103 by moving rectilinearly and reciprocally in parallel with the document base glass 103, or to rest at a home position inside the image reading frame 102*a* when the image reading unit 109 is not reading an image.

The cover 105 is installed so as to be openable away from and closable against the top surface of the document base glass 103, and presses the upper surface of the document D4 resting on the upper surface of the document base glass 103.

The automatic document feeding unit 120 includes a document stacking tray 121 for stacking documents D3, rollers 123*a*, 123*b*, 123*c* for picking up, conveying, and ejecting documents D3 from the document stacking tray 121, and a document ejection tray 125 for stacking documents D3 after they have been ejected. The roller 123*a* is a pickup roller for picking up the documents D3 stacked in the document stacking tray 121, the roller 123*b* is a conveyance roller for conveying the picked up documents D3 to the document base glass 103, and the roller 123*c* is an ejection roller for ejecting the conveyed documents D3 to the document ejection tray 125.

The automatic document feeding unit 120 is provided at one side of the upper portion of the cover 105, and is mounted so as to move together with the cover 105 as the cover 105 is opened and closed.

The image forming section 100P includes an image forming frame 102*b*, a paper feeding unit 130, an image forming unit 150, a transferring unit 170, a fixing unit 180, and a paper ejecting unit 190.

The image forming frame 102*b* forms the image forming body 102 together with the image reading frame 102*a* described above.

The paper feeding unit 130 is for supplying the recording materials 101 to the image forming unit 150 and includes a recording material cassette 131 that is attachable to and removable from the image forming frame 102*b*, and a knock-up plate 135 that is provided in the recording material cassette 131 where it can move up and down and is elastically supported upwardly by an elastic member 133, and has the recording materials 101 stacked on its top surface. In addition, the paper feeding unit 130 includes a pickup roller 137 for picking up the recording materials 101 stacked on the knock-up plate 135, and a feed roller 138 for feeding the recording materials 101 picked up by the pickup roller 137 to the image forming unit 150. The recording material cassette 131 is additionally provided with a recording material guide 139 for lining up the side edges of the recording materials 101 stacked on the knock-up plate 135 in the width direction. The recording material guide 139 may also be formed so as to line up the end edges of the recording materials 101 in the length direction.

The image forming unit 150 forms a toner image on a photoconductor 151 through charging, exposing, and developing.

The image forming unit 150 includes a cartridge 152, a charging roller 153 for charging the surface of the photoconductor 151, a laser beam scanning unit 155 for scanning a laser beam across the charged surface of the photoconductor 151 to form an electrostatic latent image on the photoconductor 151, and a developing roller 157 for developing the electrostatic latent image formed on the photoconductor 151 using toner to form a toner image on the photoconductor 151. The developing roller is in contact with the surface of the photoconductor 151 and rotates so as to apply the toner to the surface of the photoconductor 151.

The transferring unit 170 includes a transferring roller 171 that rotates while contacting the photoconductor 151 to transfer the toner image formed on the photoconductor 151 onto the recording materials 101.

The fixing unit 180 is for fixing the toner image transferred by the transferring roller 171 of the transferring unit 170 on the recording materials 101, and includes a heating roller 181 that is heated to a high temperature, and a pressing roller 183 that rotates while contacting the heating roller 181. The recording materials 101 are conveyed between the heating roller 181 and the pressing roller 183 to fix the toner image on the recording materials 101.

The paper ejecting unit 190 ejects the recording materials 101 on which the toner image has been fixed by the fixing unit 180 onto a paper ejecting plate 191 that is provided outside the image forming frame 102*b*, and includes paper ejecting rollers 193*a*, 193*b*, 193*c*.

A multipurpose paper feed device 201 for supplying recording materials one sheet at a time or for performing other functions is installed at one side of the image forming frame 102*b* in an opening and closing manner. A top cover 203 for replacing the image forming unit 150 or removing jammed recording materials is installed at one side of the image forming frame 102*b* adjacent to the paper ejecting plate 191 in an opening and closing manner. A rear cover 205 is installed at the other side of the image forming frame 102*b* in an opening and closing manner, that is, at the opposite side of the image forming frame 102*b* from the multipurpose paper feed device 201. The rear cover 205 is used for replacing the fixing unit 180 or removing jammed recording materials.

Various ones of the rollers described above are directly connected to a motor, or are connected to a motor through relay gears, in order to receive power from the motor. A main motor 211, a fixing motor 213, a paper ejecting motor 215, and a scanning motor 217 are shown in FIG. 4.

The main motor 211 primarily supplies power for driving the pickup roller 137, the feed roller 138, the photoconductor 151, the developing roller 157, the charging roller 153, and the transferring roller 171.

The fixing motor 213 supplies power for driving the heating roller 181 and the pressing roller 183 of the fixing unit 180.

The paper ejecting motor 215 supplies power for driving the paper ejecting rollers 193*a*, 193*b*, 193*c*. The paper ejecting motor 215 may also drive a fan (not shown) for exhausting heat generated inside the image forming frame 102*b* by the fixing unit 180 which operates at a high temperature.

The scanning motor 217 supplies power for moving the image reading unit 109 rectilinearly and reciprocally in parallel with the document base glass 103.

In the image forming apparatus 100 described above, the main motor 211, the fixing motor 213, the paper ejecting motor 215, and the scanning motor 217 are provided. However, the invention is not limited to this example, but the number of motors may be decreased or increased by providing the motors in diverse forms. For example, the main motor 211 and the fixing motor 213 may be formed in one body, or the fixing motor 213 and the paper ejecting motor 215 may be formed in one body.

The image forming apparatus 100 described above is additionally provided with a locking unit for locking movable objects.

A movable object to be locked may be any one of the image reading unit 109 that moves rectilinearly and reciprocally inside the image reading frame 102*a* of the image forming body 102, the cover 105 that is openable away from and closable against the document base glass 103, and the opening/closing members for opening and closing the image forming body 102 such as the multipurpose paper feed device 201, the top cover 203, and the rear cover 205. In addition, a movable object to be locked may be any one of the recording material cassette 131 that is attachable to and removable from the image forming frame 102*b* of the image forming body 102, the knock-up plate 133 provided in the recording material cassette 131 that can move up and down and is elastically supported upwardly, or the recording material guide 139 for lining up the recording materials 101. Movable objects to be locked are not limited to the structures described above, but diverse structures such as a double-sided paper feed device or a supplemental paper feed device may also be a movable object to be locked. Any combination of two or more of the structures described above may be movable objects to be locked.

Such movable objects are easily moved when image forming apparatus 100 is shipped or moved, and can be easily broken in such circumstances. Therefore, an aspect of the present invention is an image forming apparatus 100 in which movable objects are locked when the image forming apparatus 100 is shipped or moved, and are automatically unlocked when a user uses the image forming apparatus 100.

L1-L4 in FIG. 4 denotes the portions of the image forming apparatus 100 to which the locking unit referred to above is applied.

FIGS. 5A to 5D are views for explaining the operation of movable object locking units of an image forming apparatus according to an aspect of the invention.

Referring to FIGS. 5A to 5D, a locking unit 300 and a control unit 500 for controlling locking and releasing operations of the locking unit 300 are depicted.

A locking unit 300 includes a latching member 310 that is provided on the movable objects described above and has a latching depression 311, a supporting member 330 that is provided on the image forming body 102 (i.e., on the image reading frame 102*a* or the image forming frame 102*b*), and a locking member 350 that is movably supported by the supporting member 330 so as to be insertable into or removable from the latching depression 311 of the latching member 310.

The latching depression 311 has nut threads 313 formed therein, and the end portion of the locking member 350 has bolt threads 353 corresponding to the nut threads 313 formed thereon. The nut threads 313 are preferably formed in the latching depression 311 only up to a point that is a certain distance H away from the end of the latching depression 311 so that the locking member 350 can be easily removed from the latching depression 311.

The supporting member 330 is provided on the image forming body (the image reading frame 102*a* or the image forming frame 102*b*) facing the latching member 310 across a certain gap, and includes supporting frames 331, 333 provided with supporting holes 331*a*, 333*a* through which the locking member 350 passes so as to be supported by the supporting frames 331, 333 of the supporting member 330.

The control unit 500 includes a controller 510 for judging if a state of the image forming apparatus 100 is a state in which the locking unit 300 is to be locked or a state in which the locking unit 300 is to be released, a driving unit 530 for driving the locking member 350, and a driver 550 for receiving a signal from the controller 510 and driving the driving unit 530.

The driving unit 530 includes a motor 531 for generating a driving force, a driving gear 533 that rotates when it receives the driving force from the motor 531, and a gear 355 that is formed on the outer surface of the locking member 350 so as to engage and be rotated by the driving gear 533. The driving gear 533 may be directly connected to the motor 531 so as to directly receive the driving force from the motor 531, or may receive the driving force indirectly from the motor 531 through a relay gear train. If a relay gear train is used, the motor 531 can be replaced by a motor for driving one or more of the operating units of the image forming apparatus 100. The motor for driving one or more of the operating units may be the main motor 211, the fixing motor 213, the paper ejecting motor 215, the scanning motor 217, or any other motor provided for driving one or more of the operating units. FIG. 4 is an example showing the top cover 203 and the multipurpose paper feed device 201 being connected to the main motor 211 through a relay gear train 210. Any combination of two or more of the motors described above may be used to replace the motors 531 in any combination of two or more of the locking units 300.

The driving gear 533 rotates at a fixed position in a linear direction, and the thickness t1 of the driving gear 533 is preferably greater than the thickness t2 of the gear 355. The reason for this is to enable the driving gear 533 to guide the gear 355 so that the gear 355 moves a certain distance in the linear direction while engaging and being rotated by the driving gear 533. The gear 355 moves away from the latching member 310 in the linear direction when the driving gear 533 rotates in a releasing direction as a result of the bolt threads 353 of the locking member 350 unscrewing from the nut threads 313 of the latching member 310, and moves toward the latching member 310 in the linear direction when the driving gear 533 rotates in a locking direction opposite to the releasing direction as a result of the bolt threads 353 of the locking member 350 screwing into the nut threads 313 of the latching member 310. As a matter of course, diverse gears such as a bevel gear, a helical gear, a rack-and-pinion gear, a spur gear, or any other suitable type of gear may be applied to both the gear 355 and the driving gear 533, taking into consideration the direction of the driving axis and the engagement ratio of the gear 355 and the driving gear 533.

In addition, an elastic member 381 is provided between the gear 355 and the supporting frame 333. The elastic member 381 applies an elastic force between the gear 355 and the supporting frame 333, which acts as a releasing force for releasing the locking member 350.

A state of the image forming apparatus 100 which the controller 510 judges to be a state in which the locking unit 300 is to be released may be a certain standby state such as a standby state in which power to the image forming apparatus 100 is turned on, or a standby state in which each operating unit, e.g., the paper feeding unit 130, the image reading unit 109, the image forming unit 150, the fixing unit 180, the paper ejecting unit 190, and the like, is ready to start operating. The standby state in which each operating unit is ready to start operating may be a standby state in which image reading is possible, a standby state in which printing is possible, or a standby state in which each operating unit is warmed up.

A state of the image forming apparatus 100 which the controller 510 judges to be a state in which the locking unit 300 is to be locked may be a state in which a user desires to move and reinstall the image forming apparatus 100. In this state, if the user selects a locking function through an operation such as pressing a locking button provided in an operating unit for operating the image forming apparatus 100, the locking unit 300 is relocked. In the example of the locking unit 300 described above, the relocking is accomplished by rotating the driving gear 533 described above in the locking direction opposite to the releasing direction to move the locking member 350 toward the latching member 310 in the linear direction so as to insert the locking member 350 into the latching member 310 and screw the bolt threads 353 on the locking member 350 into the nut threads 313 of the latching member 310.

The locking member 350 described above may be formed so as to be operated manually after a user thoroughly learns how to release it by reading a user's manual. For this purpose, a manual operator 357 is provided at the end portion of the locking member 350. The manual operator 357 is preferably formed by a tool socket 357*a* corresponding to a manual tool 358. The manual operator 357 may be formed so as to be operated simply by hand without using the manual tool 358.

The operation of the locking unit 300 described above will be explained below with an example of releasing the locking unit 300.

Figure 5A:
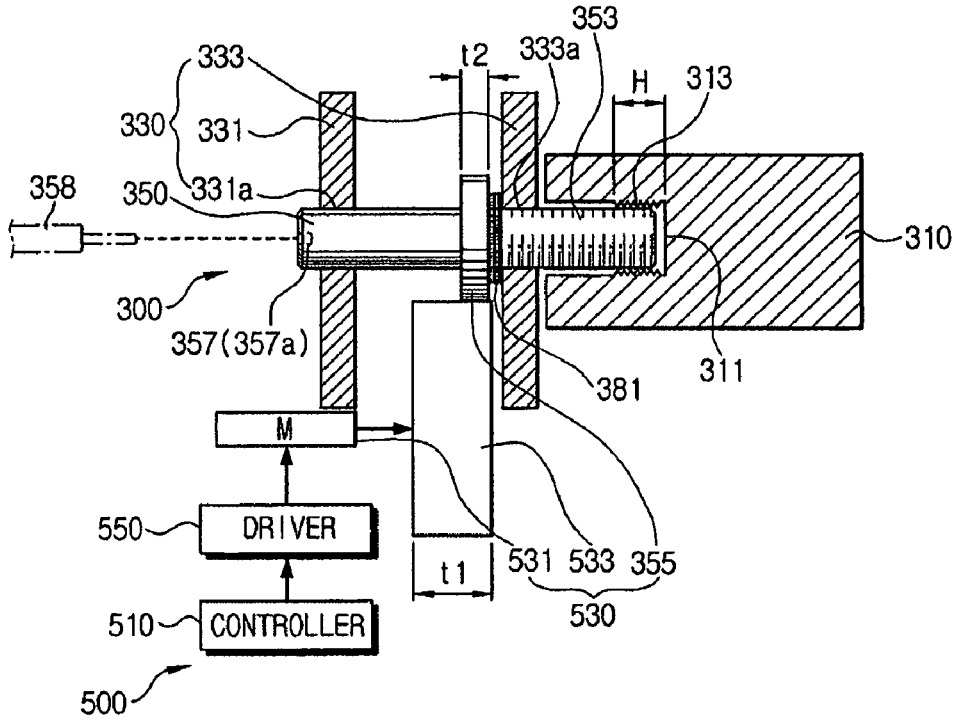
FIGS. 5A to 5D are views for explaining the operation of movable object locking units of an image forming apparatus according to an aspect of the invention which may be used in the image forming apparatus shown in FIG. 4.

First, as shown in FIG. 5A, the locking member 350 has been inserted into the latching depression 311 of the latching member 310, and the bolt threads 353 of the locking member 350 have been screwed into the nut threads 313 of the latching member 310 so that movable objects in the image forming apparatus 100 (the image reading unit 109, the cover 105, the multipurpose paper feed device 201, the top cover 203, the rear cover 205, the recording material cassette 131, the knock-up plate 133, the recording material guide 139, and the like) cannot move, thereby achieving the locking state. Accordingly, when the image forming apparatus 100 is shipped and moved, the movable objects do not move, thereby maintaining the image forming apparatus 100 in a stable state.

Figure 5B:
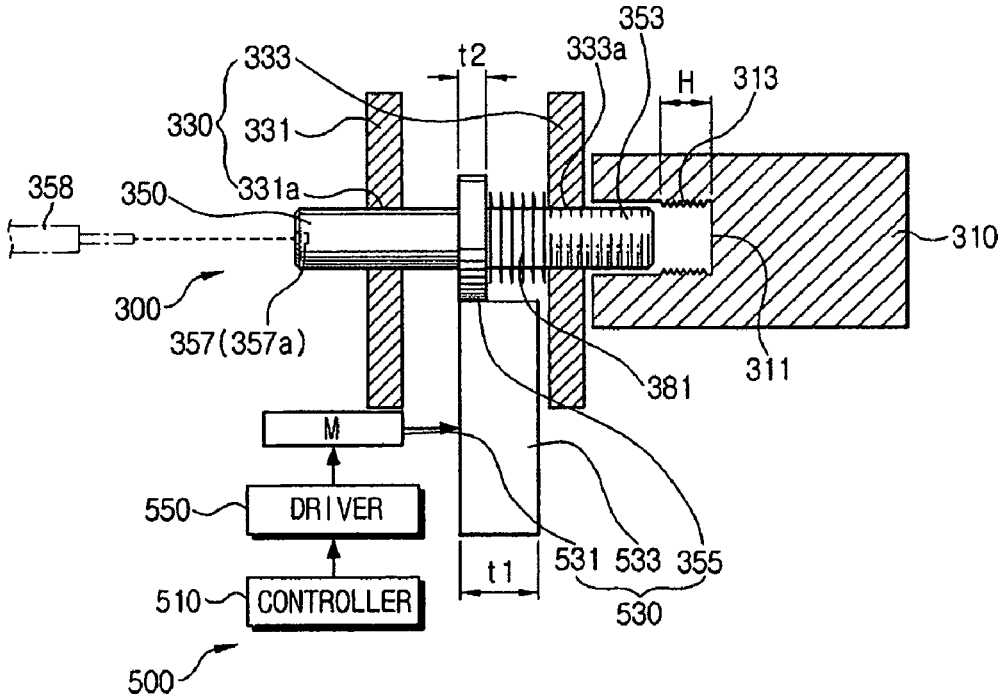
Figure 5C:
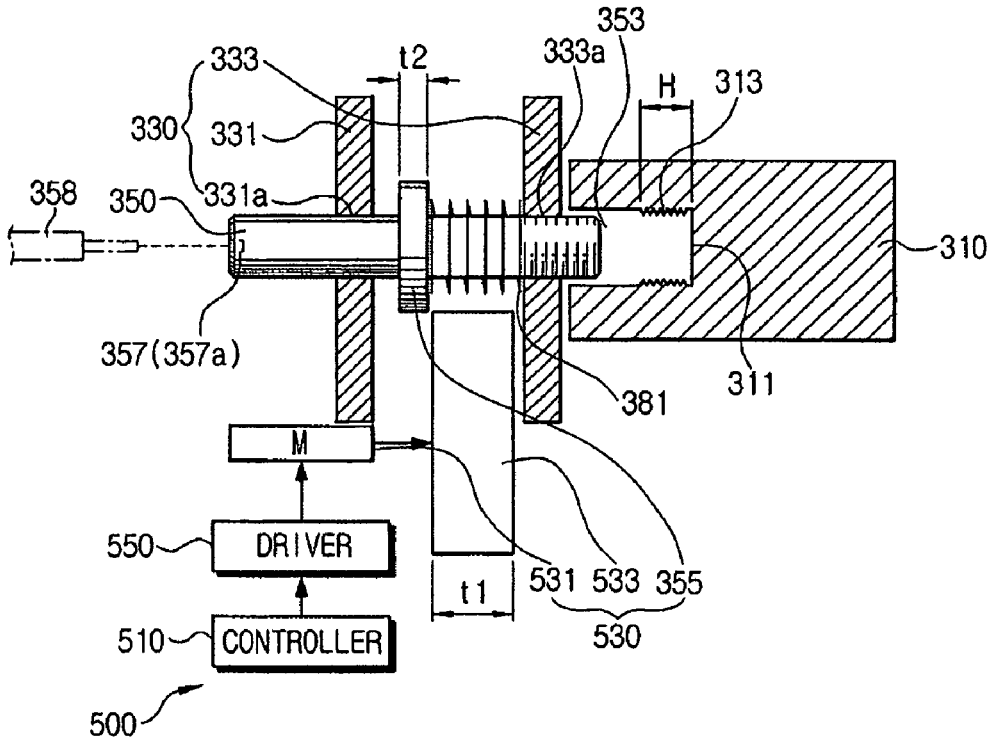

Thereafter, as shown in FIGS. 5B and 5C, if a user performs an operation such as pressing a power switch, the controller 510 judges that this state is a state in which the locking unit 300, is to be released and outputs a driving signal to the driver 550. Then, the driver 550 drives the driving unit 530 according to the signal received by the driver 550 from the controller 510. Considering the driving operation in detail, when the motor 531 is driven, the drive driving gear 533 rotates in the releasing direction, and the gear 355 engaging the driving gear 533 is accordingly rotated by the driving gear 533. At this point, the driving gear 533 rotates in the releasing direction at the fixed position in the linear direction, so that the locking member 350 moves away from the latching member 310 in the linear direction while the gear 355 is engaging and being rotated by the driving gear 533 as a result of the bolt threads 353 of the locking member 350 unscrewing from the nut threads 313 of the latching member 310.

Figure 5D:
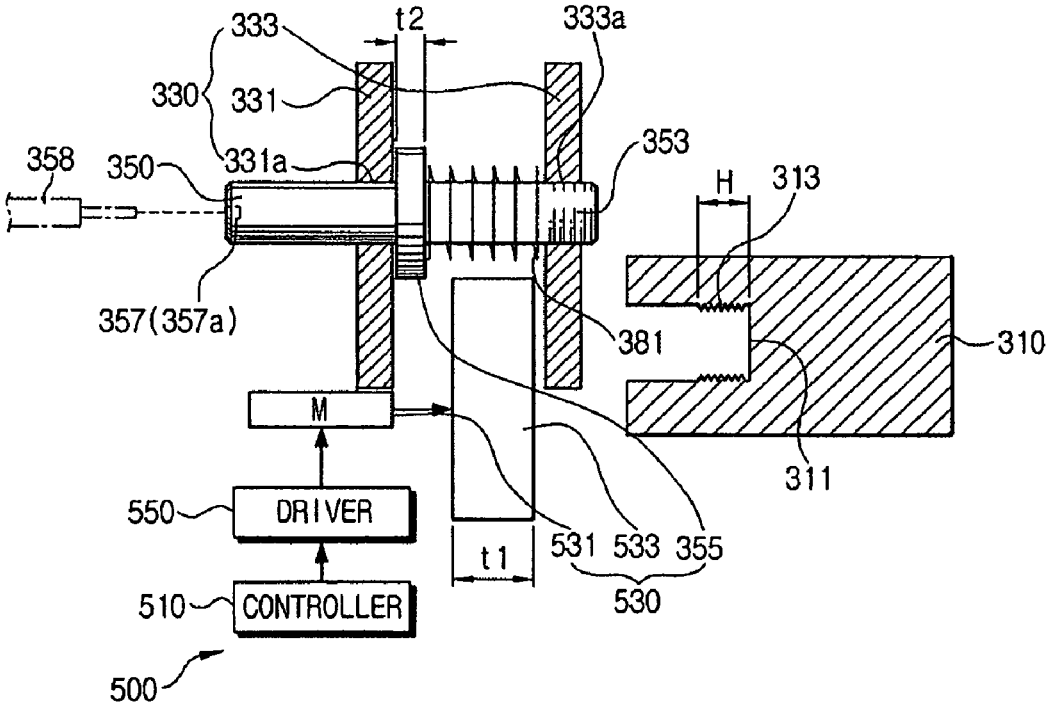

Then, as shown in FIG. 5D, when the locking member 350 has moved away from the latching member 310 in the linear direction until it has reached a point where the gear 355 is separated from the driving gear 533, the locking member 350 is removed from the latching depression 311 by the elastic force of the elastic member 381, so that the locking unit 300 is released, thereby enabling the latching member 310 and the movable object on which the latching member 310 is provided to move.

FIGS. 5A through 5D explain the operation of the locking unit 300 as applied to the image reading unit 109 to lock the image reading unit 109 in place at the home position inside the image reading frame 102*a*. FIG. 5D shows a state where the locking unit 300 has been released and the latching member 310 and the image reading unit 109 on which the latching member 310 is provided have moved away from the locking member 350 and the home position of the image reading unit 109 inside the image reading frame 102*a* as the image reading unit 109 begins an image reading operation.

After the image reading unit 109 has completed the image reading operation, the image reading unit 109 returns to the home position inside the image reading frame 102*a* where the latching depression 311 of the latching member 310 provided on the image reading unit 109 is aligned with the locking member 350. In this state, if the user selects the locking function through an operation such as pressing the locking button provided in the operating unit for operating the image forming apparatus 100, the locking unit 300 is relocked as described above, thereby locking the image reading unit 109 in place at the home position inside the image reading frame 102*a*.

When the locking unit 300 is an unlocked state, the locking member 350 is held away from the latching depression 311 of the latching member 310 by the elastic force of the elastic member 381. Therefore, before the locking unit 300 can be relocked, the locking member 350 must be reinserted in the latching depression 311 of the latching member 310 so that the bolt threads 353 on the locking member 350 can engage the nut threads 313 of the latching member 310. One way of accomplishing this is to use a pressing device (not shown) to press the locking member 350 into the latching depression 311 of the latching member 310. One example of such a pressing device is a solenoid with a plunger that presses the locking member 350 into the latching depression 311 of the latching member 310 when the solenoid is energized. However, any suitable pressing device may be used. Alternatively, the user may manually press the locking member 350 into the latching depression 311 of the latching member 310 using, for example, either the manual tool 358 or one of the user's fingers.

When the locking unit 300 is applied to a movable object that can be opened and closed, such as the cover 105, the multipurpose paper feed device 201, the top cover 203, and the rear cover 205, the latching member 310 and the locking member 350 are disposed so that the latching depression 311 of the latching member 310 provided on the movable object is aligned with the locking member 350 when the movable object is closed to enable the locking unit 300 to be relocked.

When the locking unit 300 is applied to a movable object that can be attached to or detached from the image forming apparatus 100, such as the recording material cassette 131, the latching member 310 and the locking member 350 are disposed so that the latching depression 311 of the latching member 310 provided on the movable object is aligned with the locking member 350 when the movable object is attached to the image forming apparatus to enable the locking unit 300 to be relocked.

When the locking unit 300 is applied to a movable object that can be moved to different positions, such as the knock-up plate 133 provided in the recording material cassette 131 and the recording material guide 139, the latching member 310 and the locking member 350 are disposed so that the latching depression 311 of the latching member 310 provided on the movable object is aligned with the locking member 350 when the movable object is at a predetermined position to enable the locking unit 300 to be relocked.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

an image forming body;

a locking unit blocking movement of at least one movable object of the image forming body; and a control unit controlling a locking state of the locking unit and a releasing state of the locking unit;

wherein:

the control unit automatically releases the locking unit so that the locking unit is in a released state before the image forming body begins forming an image, and maintains the locking unit in the released state while the image forming body is forming the image;

the control unit relocks the locking unit so that the locking unit is once again in a locked state in response to a locking command set by a user after the locking unit has been in the released state as a result of the control unit automatically releasing the locking unit; and the locking unit comprises two threaded members that are engaged with one another when the locking unit is in the locked state, and that are disengaged from one another when the locking unit is in the released state.

2. The apparatus as claimed in claim 1, wherein the at least one movable object is any one or any combination of an image reading unit reading images of documents, a cover installed on the image forming body so as to be openable away from and closable against a top surface of a document base glass on which a document is to be placed, a recording material cassette supplying recording materials on which images are to be formed based on the images read by the image reading unit, the recording material cassette being attachable to and removable from the image forming body, a knock-up plate installed inside the recording material cassette on which recording materials are to be stacked, a covering member opening and closing the image forming body, a multipurpose paper feed device feeding recording materials one sheet at a time or performing other functions, and a recording material guide lining up recording materials stacked on the knock-up plate in a width direction and/or a length direction.

3. The apparatus as claimed in claim 2, wherein the covering member is a rear cover installed on a rear surface of the image forming body to replace a fixing unit installed inside the image forming body and/or to remove jammed recording materials from inside the image forming body, and/or a top cover installed on a top surface of the image forming body to replace a developing unit installed inside the image forming body and/or to remove jammed recording materials from inside the image forming body.

4. The apparatus as claimed in claim 1, wherein:

the locking unit further comprises supporting member provided on the image forming body; and the two threaded members of the locking unit comprise:

a threaded latching member provided on one of the at least one movable object and provided with a threaded latching depression; and a threaded locking member movably supported by the supporting member so as to be insertable into and removable from the threaded latching depression of the threaded latching member.

5. The apparatus as claimed in claim 1, wherein the control unit comprises:

a controller judging if a state of the image forming apparatus is a state in which the locking unit is to be locked or a state in which the locking unit is to be released;

a driving unit driving the locking unit; and a driver operating the driving unit according to an output signal of the controller if the controller judges the state of the image forming apparatus to be a state in which the locking unit is to be locked or a state in which the locking unit is to be released.

6. The apparatus as claimed in claim 5, wherein a state of the image forming apparatus in which the locking unit is to be released is a state in which power to the image forming apparatus is turned on or a state in which operating units in the image forming body are ready to start operating.

7. The apparatus as claimed in claim 5, wherein a state of the image forming apparatus in which the locking unit is to be locked is a state in which the locking command is set by the user.

8. An image forming apparatus comprising:

an image forming body;

a locking unit blocking movement of at least one movable object of the image forming body; and a control unit controlling a locking state of the locking unit and a releasing state of the locking unit;

wherein:

the control unit automatically releases the locking unit so that the locking unit is in a released state before the image forming body begins forming an image, and maintains the locking unit in the released state while the image forming body is forming the image;

the control unit relocks the locking unit so that the locking unit is once again in a locked state in response to a locking command set by a user after the locking unit has been in the released state as a result of the control unit automatically releasing the locking unit;

the locking unit comprises:

a latching member provided on one of the at least one movable object and provided with a latching depression;

a supporting member provided on the image forming body; and a locking member movably supported by the supporting member so as to be insertable into and removable from the latching depression of the latching member; and the latching depression has nut threads formed therein, and an end portion of the locking member has bolt threads corresponding to the nut threads formed thereon.

9. The apparatus as claimed in claim 8, wherein the nut threads are formed in the latching depression only up to a point that is a certain distance away from an end of the latching depression.

10. An image forming apparatus comprising:

an image forming body;

a locking unit blocking movement of at least one movable object of the image forming body; and a control unit controlling a locking state of the locking unit and a releasing state of the locking unit;

wherein:

the control unit automatically releases the locking unit so that the locking unit is in a released state before the image forming body begins forming an image, and maintains the locking unit in the released state while the image forming body is forming the image;

the control unit relocks the locking unit so that the locking unit is once again in a locked state in response to a locking command set by a user after the locking unit has been in the released state as a result of the control unit automatically releasing the locking unit;

the locking unit comprises:

a latching member provided on one of the at least one movable object and provided with a latching depression;

a supporting member provided on the image forming body; and a locking member movably supported by the supporting member so as to be insertable into and removable from the latching depression of the latching member; and the supporting member is provided on the image forming body facing the latching member across a certain gap and comprises a supporting frame provided with a supporting hole through which the locking member passes so as to be supported by the supporting frame of the supporting member, and an elastic member is provided between a portion of the latching member and the supporting frame.

11. An image forming apparatus comprising:

an image forming body;

a locking unit blocking movement of at least one movable object of the image forming body; and a control unit controlling a locking state of the locking unit and a releasing state of the locking unit;

wherein:

the control unit automatically releases the locking unit so that the locking unit is in a released state before the image forming body begins forming an image, and maintains the locking unit in the released state while the image forming body is forming the image;

the control unit relocks the locking unit so that the locking unit is once again in a locked state in response to a locking command set by a user after the locking unit has been in the released state as a result of the control unit automatically releasing the locking unit;

the locking unit comprises:

a latching member provided on one of the at least one movable object and provided with a latching depression;

a supporting member provided on the image forming body; and a locking member movably supported by the supporting member so as to be insertable into and removable from the latching depression of the latching member; and a manual operating unit is provided at an end portion of the locking member to enable the locking member to be operated manually.

12. The apparatus as claimed in claim 11, wherein the manual operating unit is a tool socket corresponding to a manual tool.

13. An image forming apparatus comprising:

an image forming body;

a locking unit blocking movement of at least one movable object of the image forming body; and a control unit controlling a locking state of the locking unit and a releasing state of the locking unit;

wherein the control unit comprises:

a controller judging if a state of the image forming apparatus is a state in which the locking unit is to be locked or a state in which the locking unit is to be released;

a driving unit driving the locking unit; and a driver operating the driving unit according to an output signal of the controller if the controller judges the state of the image forming apparatus to be a state in which the locking unit is to be locked or a state in which the locking unit is to be released;

wherein the driving unit comprises:

a motor generating a driving force;

a driving gear directly or indirectly connected to the motor and rotatable in a locking direction to lock the locking unit and a releasing direction to release the locking unit; and a gear provided on the locking unit and engaging the driving gear; and wherein the driving gear rotates at a fixed position in a linear direction, and a thickness of the driving gear is greater than a thickness of the gear provided on the locking unit.

14. The apparatus as claimed in claim 13, wherein the motor is any one of motors that drive operating units in the image forming body, and the driving gear is directly connected to the any one of the motors that drive the operating units or is connected to the any one of the motors that drive the operating units through at least one relay gear.

15. An image reading apparatus comprising:

an image reading main body;

a document base glass installed on a top surface of the image reading main body and having a top surface on which documents are to be placed in a stationary state and/or a moving state;

an image reading unit installed facing the document base glass reading images of the documents placed on the document glass;

a cover installed on the image reading main body so as to be openable away from and closable against the top surface of the document base glass;

a locking unit blocking movement of the image reading unit or the cover; and a control unit controlling a locking state of the locking unit and a releasing state of the locking unit;

wherein:

the control unit automatically releases the locking unit so that the locking unit is in a released state before the image reading unit begins reading an image, and maintains the locking unit in the released state while the image reading unit is reading the image;

the control unit relocks the locking unit so that the locking unit is once again in a locked state in response to a locking command set by a user after the locking unit has been in the released state as a result of the control unit automatically releasing the locking unit; and the locking unit comprises two threaded members that are engaged with one another when the locking unit is in the locked state, and that are disengaged from one another when the locking unit is in the released state.

16. An image forming apparatus comprising:

an image forming body;

a movable object disposed in the image forming body;

a controllable locking unit to selectively lock the movable object to prevent the movable object from moving and release the movable object to allow the movable object to move; and a control unit to control the controllable locking unit to selectively lock and release the movable object;

wherein:

the control unit automatically controls the controllable locking unit to release the movable object so that the controllable locking unit is in a released state before the image forming body begins forming an image, and to maintain the controllable locking unit in the released state while the image forming body is forming the image;

the control unit controls the controllable locking unit to relock the movable object so that the controllable locking unit is once again in a locked state in response to a locking command set by a user after the controllable locking unit has been in the released state as a result of the control unit automatically controlling the controllable locking unit to release the movable object; and the controllable locking unit comprises two threaded members that are engaged with one another when the locking unit is in the locked state, and that are disengaged from one another when the locking unit is in the released state.

17. The apparatus as claimed in claim 16, further comprising:

a plurality of operating units disposed in the image forming body that cooperate to form an image on a recording material;

at least one recording material supply unit to supply the recording material, the recording material supply unit being attachable to and removable from the image forming body; and at least one covering member to open and close an opening in the image forming body;

wherein the movable object is one of the operating units, or one of the at least one recording material supply unit, or one of the at least one covering member.

18. The apparatus as claimed in claim 16, wherein:

the two threaded members of the controllable locking unit comprise:

a threaded latching member disposed on the movable object; and a threaded locking member movably disposed in the image forming body to be selectively lockable to and releasable from the threaded latching member; and the controllable locking unit further comprises a driving unit to drive the threaded locking member to selectively lock to and release from the threaded latching member, thereby causing the controllable locking unit to selectively lock and release the movable object.

19. The apparatus as claimed in claim 18, wherein the driving unit comprises a motor coupled to the locking member; and wherein the control unit controls the motor to operate in a locking direction to drive the locking member to lock to the latching member, thereby controlling the controllable locking unit to lock the movable object, and controls the motor to operate in a releasing direction opposite to the locking direction to drive the locking member to release from the latching member, thereby controlling the controllable locking unit to release the movable object.

20. The apparatus as claimed in claim 19, wherein the driving unit further comprises:

a driving gear coupled to the motor; and a gear disposed on the locking member and engaging the driving gear during at least a portion of a locking operation of the controllable locking unit and a portion of a releasing operation of the controllable locking unit.

21. The apparatus as claimed in claim 19, further comprising a plurality of operating units disposed in the image forming body that cooperate to form an image on a recording material;

wherein the motor is coupled to the locking member and at least one of the operating units to drive the locking member and the at least one of the operating units.

22. The apparatus as claimed in claim 16, wherein the control unit monitors a state of the image forming apparatus, controls the controllable locking unit to lock the movable object if the control unit judges that the state of the image forming apparatus is a state in which the movable object is to be locked, and controls the controllable locking unit to release the movable object if the control unit judges that the state of the image forming apparatus is a state in which the movable object is to be released.

23. The apparatus as claimed in claim 22, wherein the state in which the movable object is to be locked is a state in which the image forming apparatus is to be shipped, or a state in which the image forming apparatus is to be moved, or a state in which the user has set the locking command, thereby indicating that the movable object is to be locked.

24. The apparatus as claimed in claim 22, wherein the state in which the movable object is to be released is a state in which power to the image forming apparatus is turned on, or a state in which the image forming apparatus is ready to start operating.

25. An image reading apparatus comprising:

an image reading main body;

a document base glass disposed on the main body on which a document is to be placed;

an image reading unit disposed in the image reading main body facing the document base glass and being movable relative to the document base glass to read an image of a document placed on the document base glass;

a cover disposed on the image forming body and being openable away from and closable against the document base glass;

a controllable locking unit to selectively lock the image reading unit or the cover to prevent the image reading unit or the cover from moving and release the image reading unit or the cover to allow the image reading unit or the cover to move; and a control unit to control the controllable locking unit to selectively lock and release the image reading unit or the cover;

wherein:

the control unit automatically controls the controllable locking unit to release the image reading unit or the cover so that the controllable locking unit is in a released state before the image reading unit begins reading an image, and to maintain the controllable locking unit in the released state while the image reading unit is reading the image;and the control unit controls the controllable locking unit to relock the image reading unit or the cover so that the controllable locking unit is once again in a locked state in response to a locking command set by a user after the controllable locking unit has been in the released state as a result of the control unit automatically controlling the controllable locking unit to release the image reading unit or the and the controllable locking unit comprises two threaded members that are engaged with one another when the locking unit is in the locked state, and that are disengaged from one another when the locking unit is in the released state.

* * * * *

UNITED STATES PATENT AND TRADEMARK OFFICE

CERTIFICATE OF CORRECTION

PATENT NO. : 7,409,175 B2
APPLICATION NO. : 11/340792
DATED : August 5, 2008
INVENTOR(S) : Young-min Kim et al.

It is certified that error appears in the above-identified patent and that said Letters Patent is hereby corrected as shown below:

Column 18, line 16 claim 25, delete “and”.

Column 18, line 24 claim 25, insert --cover;-- after “the”.

Signed and Sealed this

Seventh Day of October, 2008

JON W. DUDAS
*Director of the United States Patent and Trademark Office*